United States Patent [19]

Sparrevohn

[11] 4,119,336

[45] Oct. 10, 1978

[54] SECURITY LATCH

[76] Inventor: Frederic D. R. Sparrevohn, 388 Flint Ave., Long Beach, Calif. 90814

[21] Appl. No.: 818,108

[22] Filed: Jul. 22, 1977

[51] Int. Cl.[2] ..... E05C 17/16

[52] U.S. Cl. ..... 292/268

[58] Field of Search ..... 70/93; 292/268, 269, 292/270, 265, 266, 267

[56] References Cited

U.S. PATENT DOCUMENTS

| | | | |
|---|---|---|---|
| 1,065,728 | 6/1913 | Ruckert | 292/269 |
| 1,565,713 | 12/1925 | Christiansen | 292/265 |
| 1,742,303 | 1/1930 | Christiansen | 292/265 |
| 2,369,136 | 2/1945 | Chambers et al. | 292/268 |

FOREIGN PATENT DOCUMENTS

| | | | |
|---|---|---|---|
| 712,102 | 7/1931 | France | 292/268 |

*Primary Examiner*—Richard E. Moore

*Attorney, Agent, or Firm*—Fulwider, Patton, Rieber, Lee & Utecht

[57] ABSTRACT

A security latch for a door or the like is disclosed herein having a closure element secured along the edge marginal region of a door and outwardly projecting across the gap defined between the door edge and the adjacent door jamb. The closure element terminates at its cantilevered end with an enlarged portion and is adapted to ride in a contoured groove or track carried on a latch member to establish three operative door positions. The latch member is pivotally attached to the door jamb and moves by manual disposition between the three operative positions with respect to the closure element whereby the door may be locked shut, fully opened or opened for a restricted or predetermined distance.

8 Claims, 9 Drawing Figures

FIG. 1
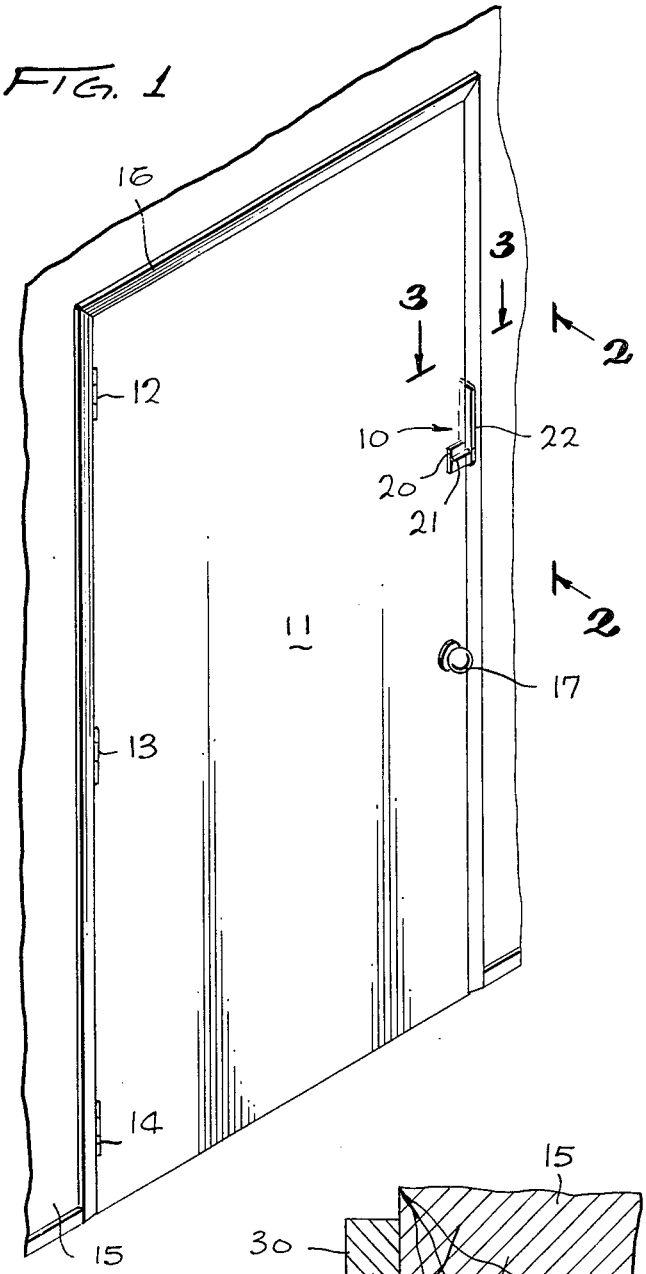
FIG. 2
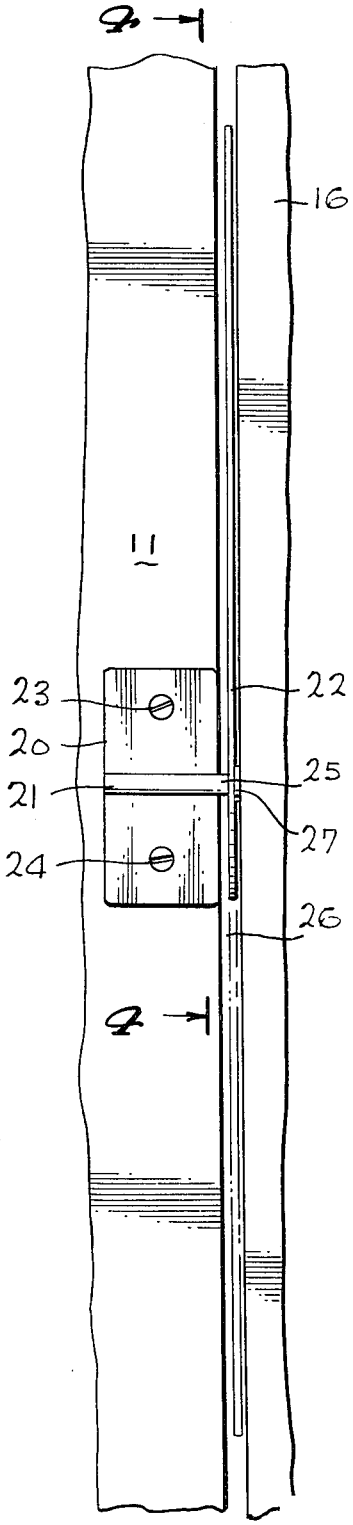
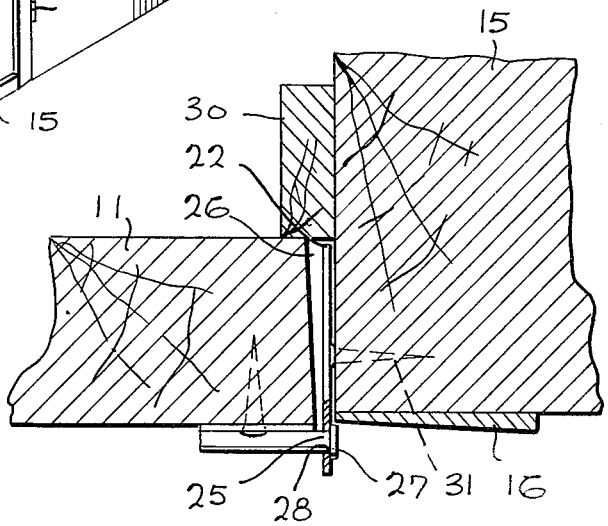
FIG. 3

SECURITY LATCH

BACKGROUND OF THE INVENTION

1. Field of the Invention

The present invention relates to security closure and latching devices and more particularly relates to a novel security latch which permits or allows selective opening, restricted opening and closed positions of a door of means of a novel closure element and latch member combination.

2. Description of the Prior Art

In the past, a variety of door latching devices have been employed for permitting a door to be opened and closed at the direction of a person within a house or room. One such prior device takes the form of a chain secured at one end to the door jamb and selectively secured at its opposite end to a shaped notch carried on a securement member fixed to the door. The operator may readily move the chain from the element secured to the door at will when it is desired to fully open the door. When the chain is affixed to the element, a restricted opening of the door is permitted so that unwanted intruders can be identified through the restricted opening between the door edge and the door jamb and still the door is prevented from opening. However, once the chain has been removed from its selected attachment with the door element, the device is inoperative and cannot prevent or restrict the door from opening. The device requires a positive detachment of the chain from the door element which requires additional positioning of the door so as to permit sufficient slack in the chain to allow the removal of the chain end from the door element. Therefore, the device is cumbersome, awkward and limited in its application as a security latch.

Other attempts have been made to provide an adequate security latch which involve rigid bolts having finger actuating elements which are positioned into respective notches arranged along the edge of a longitudinal slot. Such devices do not provide for restricted or limited opening of the door and are usually limited to either fully locking the door to the door jamb or fully opening the door for unrestricted use.

Therefore, a need has long existed to provide a novel latching mechanism which provides for restricted opening of the door and which will permit the door to be selectively opened when desired as well as closed.

SUMMARY OF THE INVENTION

Accordingly, the above problems and difficulties are obviated by the present invention which provides a novel security latch of two piece construction wherein one of the pieces is a closure element or member carried on the edge marginal region of a door so as to project an end portion thereof into the gap defined between the edge of the door and the door jamb. The projecting end of the closure element is slideably carried in a groove or track formed in the second piece which is a latch member. The latch member is pivotally mounted on the door jamb and is manually moved into one of three operative positions. Each of the positions is determined by the location of the closure element with respect to the groove or track of the latch member.

Therefore, it is among the primary objects of the present invention to provide a novel security latching means whereby restricted opening of a door is permitted as well as allowing the door to be fully opened and fully closed at the selection of the user.

Another object of the present invention is to provide a positive latching mechanism for a door closure which incorporates a pivotal latch member cooperating with a fixed closure element to provide a multiplicity of closure positions for the door with respect to the door jamb.

Still a further object of the present invention is to provide a security latching mechanism which is easy to install and which is economical to manufacture.

Still a further object of the present invention is to provide a novel security latching means which through its inherent construction provides for a multiplicity of positions for opening a door with respect to a door jamb.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is a perspective view showing a typical door in its closed position and incorporating the novel security latch of the present invention;

FIG. 2 is an enlarged elevational view of the novel security latching means of the present invention taken in the direction of arrows 2—2 of FIG. 1;

FIG. 3 is a transverse cross-sectional view of the security latching means shown in FIG. 1 as taken in the direction of arrows 3—3 thereof;

DESCRIPTION OF THE PREFERRED EMBODIMENT

Figure 4:
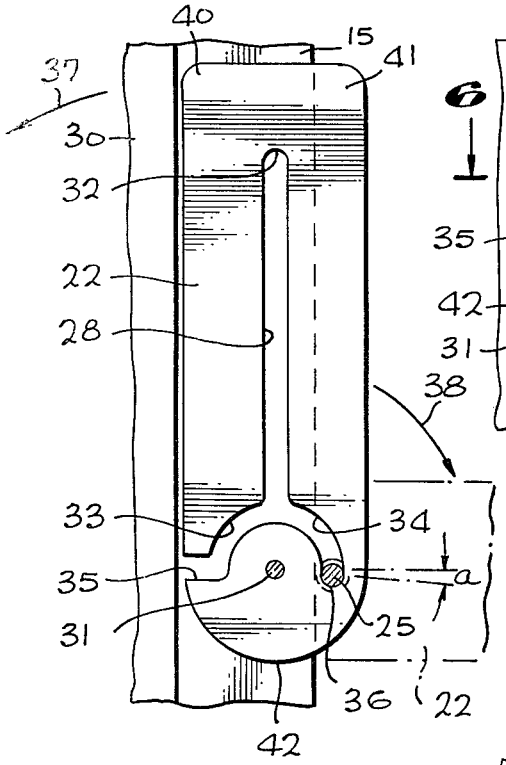
FIG. 4 is a sectional view of the latching means showing the latch member in its closed or lock position.

Referring to FIG. 1, the novel security latch means of the present invention is indicated in the general direction of arrow 10 and is illustrated as being installed on a typical door 11 so as to effect the opening or closing of the door. As is the customary practice, the door 11 is mounted by hinges 12, 13 and 14 to a frame or door jamb forming a part of wall 15. A molding or decorative strip 16 is carried on the frame or door jamb surrounding the door 11 and the molding or decorative strip defines an opening in the wall when the door 11 has been moved to its open position. A conventional door knob and door latch arrangement is indicated by numeral 17 which is used as in the conventional manner.

The security latch means 10 is of a two piece construction which is preferrably made of metal parts. One piece takes the form of a closure means 20 having an elongated element 21 which is selectively connectable with a moving latch member 22. As illustrated, the closure member and the latch member are positioned so that the door cannot be opened on its hinges 12–14 respectively.

Referring in more detail to FIGS. 2 and 3, it can be seen that the closure means 20 is secured along the edge marginal region of door 11 by means of screws 23 and 24. The mounting of the closure means is such that the elongated closure element 21 is longitudinally disposed in a horizontal position so that a terminating end 25 extends beyond the edge of the door 11 and substantially crosses a gap 26 defined between the opposing ends of door 11 and the frame or door jamb 15. The gap 26 is shown more clearly in FIG. 3. The extreme end of the portion 25 is provided with an enlarged portion 27 which is terminated short of the jamb 15.

As seen more clearly in FIG. 3, the cantilevered portion 25 extending across gap 26 is slideably related with respect to an elongated slot 28 formed in the latch member 22. FIG. 3 further illustrates that the enlarged head or portion 27 resides on the opposite side of the latch member 22 from the side facing the door 11 and that the door 11 abuts against a stop member 30 when the door is in its closed position. Also, FIG. 3 illustrates that the latch member 22 is pivotally secured to the face of the door jamb 15 opposing the face of the door edge by means of a screw 31.

Figure 7:
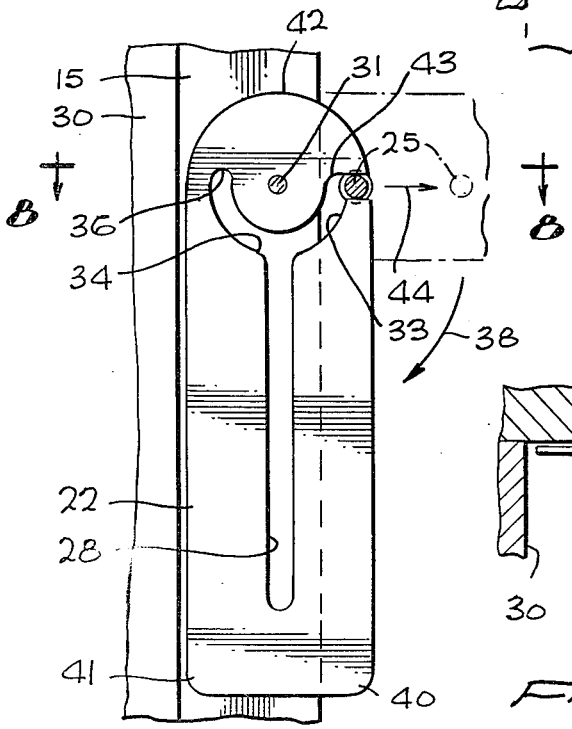
FIG. 7 is a view similar to the views of FIGS. 4 and 5 illustrating the latch member in a third operative position permitting the door to be fully opened.

Referring now in detail to FIG. 4, it can be seen that the latch member 22 includes the elongated slot 28 which is a part of a predetermined contour or track. The slot 28 terminates at one end with an abutment 32 against which the closure element 25 will abut in one of its operative positions. The opposite end of slot 28 terminates in an arcuate groove having arc portions 33 and 34 which branch out on opposite sides and terminates in an opening 35 and a second abutment 36 respectively. The three extreme ends of the groove or track will define the three operative positions of the latch means so that when the latch member 22 is in the solid line position as shown in FIGS. 1–4, the closure element 25 will abut against the abutment 36. When the closure element 25 abuts against the abutment 32 as shown in solid lines in FIG. 5, the latch is in its limited door opening position or restricted opening position. When the closure element 25 is in the opening 35 or adjacent thereto, the latch means is in the full door open or unlatched position as shown in FIG. 7. FIG. 4 further illustrates that when the closure element 25 is in abutment with the end of the slot at 36, the center of the closure element is approximately 5° below a center line normally drawn between the pivot 31 and the closure element 25. The angle is represented by the letter *a*. By this structural provision, the latch member 22 will lean slightly in the direction of arrow 37 so as to maintain the latch member 22 in the upright position shown in solid lines. However, when it is desired to move the latch member 22 into its limited door opening or restricted opening position, the latch member 22 is pivoted on the pivot means 31 in the direction of arrow 38 so as to assume the broken line position. This position and latch condition will be described with respect to FIG. 5.

Figure 5:
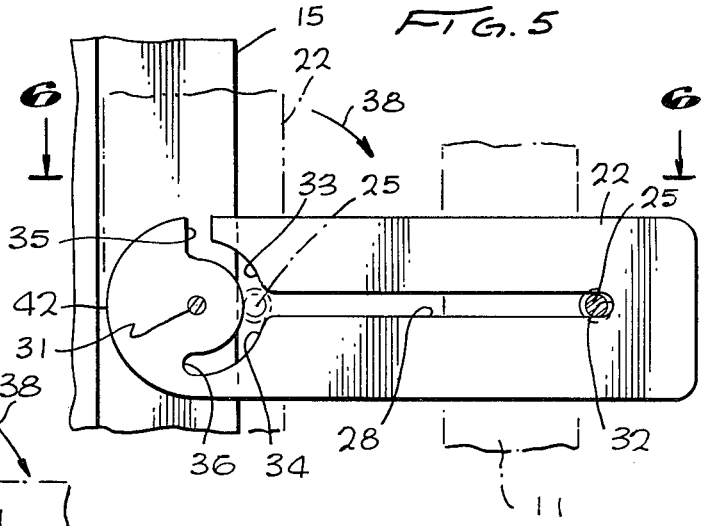
FIG. 5 is a view similar to the view shown in FIG. 4 illustrating the latch member in an alternate position wherein restricted opening of the door is permitted.

In FIG. 5, it can be seen that the latch member 22 has been pivoted in the direction of arrow 38 so that the closure element 25 has travelled through the arcuate portion 34 of the groove or track and is in alignment with the elongated slot 28. At this point, the door 11 may be pivoted on its hinges so as to open from the position shown in broken lines to the position shown in solid lines wherein the pin or closure element 25 travels the full length of slot 28 and stops at abutment 32. A feature resides in the construction of latch member 22 in that one end of the elongated construction is provided with corners 40 and 41 whereas the opposite end of the member 22 is rounded as indicated by numeral 42. By this means, the corner 41 may be grasped by the fingers of the user and the member rotated in the direction of arrow 38 whereby the rounded end 42 will easily clear the surface of stop 30. Therefore, no binding or interference between the latch member and any portion of the door jamb or stop is encountered.

Figure 6:
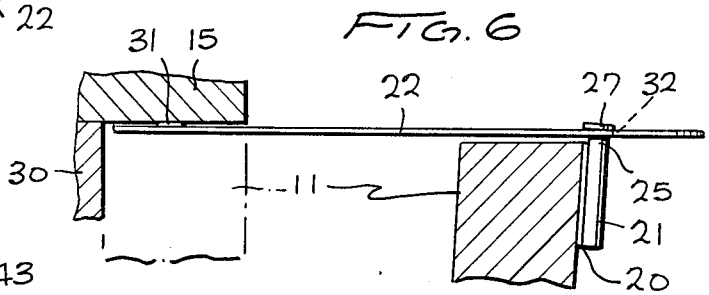
FIG. 6 is a sectional view of the restricted opening of the door as shown in FIG. 5 as taken in the direction of arrow 6—6.

In FIG. 6, the limited door opening or restricted opening position is illustrated wherein it can be seen that the closure element 25 has progressed through the slot 28 into a stopping position with abutment 32. The enlarged portion 27 is of greater diameter than the width of the slot 28 so that the closure element will remain captured with the latch member 22. It can be seen that as the door 11 is positioned to the restricted opening, the latch member 22 is pulled slightly about its pivotal mount with the door jamb from the position shown in broken lines to the position shown in solid lines. For this reason, it is preferred that the latch member 22 be composed of a strong and spring-like material such as metal or the like. By this construction, the member 22 is permitted to flex as required by the arcuate pivoting of the door 11.

Referring now in detail to FIG. 7, the third operative position of the latch means is illustrated which may be defined as the full door open or unlatched position. In this position, the closure element 25 continues from arcuate slot portion 34 past the slot 28 and into the alternate arcuate slot portion 33. When the closure element 25 butts against corner 43, the latch member 22 will remain in the downward position as illustrated after full rotation in a clockwise manner in the direction of arrow 38. Once the latch member has been positioned by the user in this condition, the closure element 25 is adjacent the opening 35 so that when the door 11 is opened by the user, the closure element 25 will progress in the direction of arrow 44 and exit the groove and disengage with the latch member 22. The latch member 22 will remain in this position until the door is again closed so that the closure element 25 re-enters opening 35 and is in abutment with the cover 43, at this time, the latch 22 may be actuated by its corner 40 by rotating in a counter clockwise direction so that the closure element 25 may be aligned with slot 28 or placed in abutment with the abutment 36.

Figure 8:
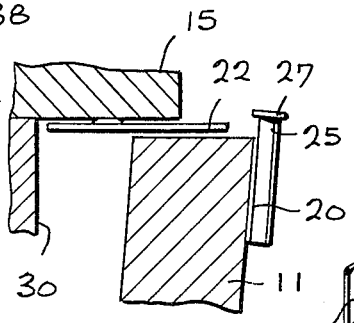
FIG. 8 is a sectional view taken in the direction of arrows 8—8 of FIG. 7.

FIG. 8 clearly shows the separation and disengagement of the closure element 25 with the latch means 22 when the door 11 is open.

Figure 9:
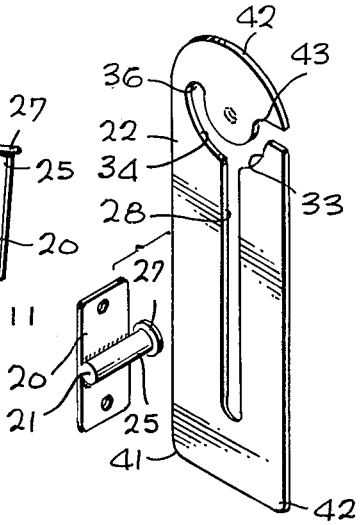
FIG. 9 is an exploded view of the closure element and the latch member.

Referring to FIG. 9, an exploded view of the two piece construction is illustrated and the respective component parts are illustrated as described and identified above. Preferably, the two piece construction is composed of metal and preferably, the closure element 21 including the portions 25 and 27 are composed of a hard and rigid metal while the latch member 22 is preferably composed of a flexible or resilient metal.

In view of the foregoing, it can be seen that the latch means of the present invention provides a security system for the occupant of a room or building wherein complete control of the door opening is under the control of the occupant. For example, when it is desired that the occupant be undisturbed and that the door be in a locked condition, the closure means 25 is located against abutment 36 when the latch member 22 is pivoted in a counter clockwise direction. In this position, the latch member 22 substantially occupies the gap 26 between the door and the door jamb and any attempt to open the door 11 is resisted by engagement of the closure portion 25 with the opposite sides of the arcuate slot 34 defining the abutment 36. When it is desired to put the door in a limited door opening position or restricted opening position, the latch member 22 is pivoted in a clockwise direction so that the closure element 25 may be introduced into the elongated slot 28 wherein the door may be opened until the element 25 bears against the abutment 32. At this point in time, the occupant may then look through the enlarged opening or gap between the door and the door jamb and identify persons outside. When it is then desired to fully open the door 11, the latch member 22 is rotated clockwise when the element 25 has again been returned to the arcuate slot whereby the element 25 enters arcuate portion 33 so that the member is rotated to the position shown in FIG. 7. At this time, the element 25 may pass through the entrance 35 when the door is opened so that complete disengagement of the closure element with the latch member is achieved.

While particular embodiments of the present invention have been shown an described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A security latch comprising:

a closure means secured along the marginal region of a door and extending beyond the edge thereof;

flat latch plate means of thickness less than a gap between said door edge and the adjacent jamb of said door and mounted for rotational movement generally tangent to said door edge in the gap between said door edge and the adjacent door jamb about an axis which is anchored to said door jam and perpendicular to said door edge when said door is closed, and wherein said latch plate means extends outward beyond the plane of said marginal region of said door when said door is closed;

said latch plate means having three operative positions constituting a latched position preventing door movement, a restricted position allowing limited door movement and an unlatched position allowing full door opening and closing movement; and said closure means being in engagement with said latch plate means in said latched and restricted positions of operation and movable with said door and freely disengageable from said latch plate means when said latch plate means is in said unlatched position.

2. The invention as defined in claim 1 wherein:

said closure means includes an elongated closure element outwardly projecting from the edge of the door; and said latch means includes an elongated member having a contoured track slideably engageable with said closure element whereby positioning of said latch member sets said closure member into a selected one of said positions.

3. The invention as defined in claim 2 wherein:

said latch member is a thin flexible sheet; and said contoured track is a groove of a substantially "Y" shape defined by an elongated slot for slidably receiving said closure element for said restricted door opening position and a pair of arcuate grooves joining with one end of said slot for said latched and unlatched positions respectively.

4. The invention as defined in claim 3 wherein:

said arcuate groove associated with said unlatched position terminates at one end with said slot and said other arcuate groove terminates at its opposite end with an opening adapted to pass said closure member therethrough allowing full door opening and closing movement.

5. The invention as defined in claim 4 wherein:

said latch member includes pivot means for movably attaching said latch member at a selected end thereof to the door jamb.

6. The invention as defined in claim 5 wherein:

said selected end of latch member is rounded into a semi-circle with the center being at said pivot means; and the opposite end of said latch member from said rounded end includes substantially square corners.

7. The invention as defined in claim 2 wherein:

said contoured track is of a substantially "Y" configuration having a stop abutment for said closure means at two locations defining the terminal ends of said track and an opening at the remaining terminal end allowing passage of said closure means.

8. The invention as defined in claim 1 further characterized in that the weight of said latch means carries said latch means from said restricted position to aid unlatched position when said door is closed.

* * * * *